United States Patent [19]

Jordon

[11] Patent Number: 4,862,906

[45] Date of Patent: Sep. 5, 1989

[54] MULTIFORM CONVERTIBLE TENT AND HAMMOCK

[76] Inventor: Dara Jordon, 1226 W. Vesta, Ontario, Calif. 91762

[21] Appl. No.: 98,114

[22] Filed: Sep. 17, 1987

[51] Int. Cl.[4] ..... E04H 15/30

[52] U.S. Cl. ..... 135/95; 5/120; 135/97; 135/117; 135/904

[58] Field of Search ..... 135/97, 95, 117, 904; 5/120, 121, 417, 419, 420

[56] References Cited

U.S. PATENT DOCUMENTS

| | | | |
|---|---|---|---|
| 1,257,484 | 3/1918 | Drexler | 5/120 |
| 1,401,846 | 12/1921 | Wiles | 5/121 |
| 2,898,609 | 8/1959 | Storie | 5/419 |
| 3,176,315 | 4/1965 | Freund | 5/417 |
| 3,699,986 | 10/1972 | Kirkham | 135/97 |
| 3,943,952 | 3/1976 | Marguart et al. | 135/117 |
| 4,001,902 | 1/1977 | Hall et al. | 5/121 |
| 4,063,566 | 12/1977 | Millerioux | 135/97 |
| 4,072,158 | 2/1978 | O'Brien et al. | 135/117 |
| 4,164,275 | 8/1979 | Davis | 5/417 |
| 4,194,601 | 3/1980 | Yellin | 5/417 |
| 4,194,785 | 3/1980 | Cox et al. | 135/904 |
| 4,471,794 | 9/1984 | Kirkham | 5/120 |
| 4,686,720 | 8/1987 | Newell | 5/121 |

*Primary Examiner*—Henry E. Raduazo

*Attorney, Agent, or Firm*—Milton S. Gerstein

[57] ABSTRACT

A tent-hammock combination, in which up to five separate structures may be formed. The first is a hammock, the second is a hanging pup tent with the hammock serving as the floor of the tent, the third a lean-to, the fourth a ground pup tent, and the fifth a family-sized tent made by transforming and joining two group pup tents. The transition from ground pup tent to either the lean-to or family-sized tent is achieved by disconnecting the rear wall of the tent or pair of tents and pivoting its upwardly. In the lean-to version, the rear wall is pivoted until it is horizontal. In the family-sized tent, the rear wall is pivoted until it forms one continuous planar surface with the front wall, after which two such transformed tents are joined to form the large, family-sized tent. In the family-sized tent, two trianagular material inserts are used to fill in the vacant volume formed in each tent when the tent's rear wall has been pivoted upwardly. The two tents are joined by mating zipper portions formed in oppositely-disposed, facing edges of triangular inserts of the two facing tents. The poles for erecting each tent are the same as those used for the family-sized tent. The two tents are also interconnected along the structural tubes at each end of the hammock by an T-bar accessory. These structural tubes not only allow for the hanging of the hammock, but also serve to hold an end of the erecting pole for erecting the tent which is detachably secured to the hammock via cooperating zipper portions.

4 Claims, 4 Drawing Sheets

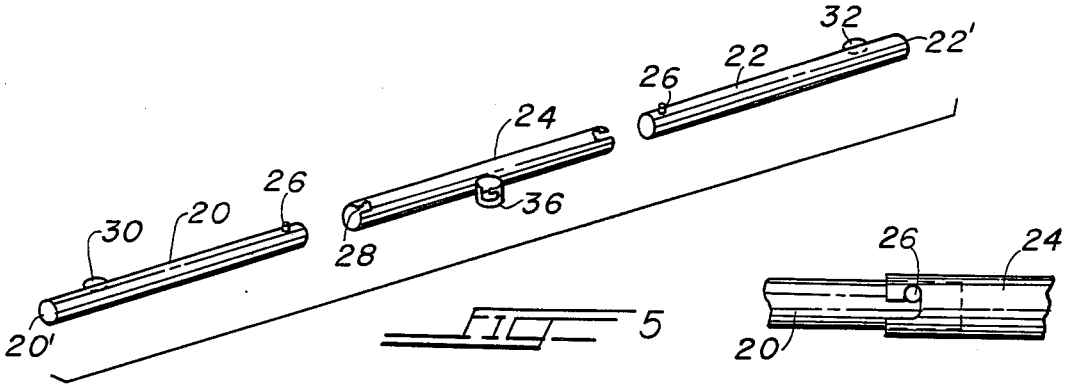
FIG. 5
FIG. 6
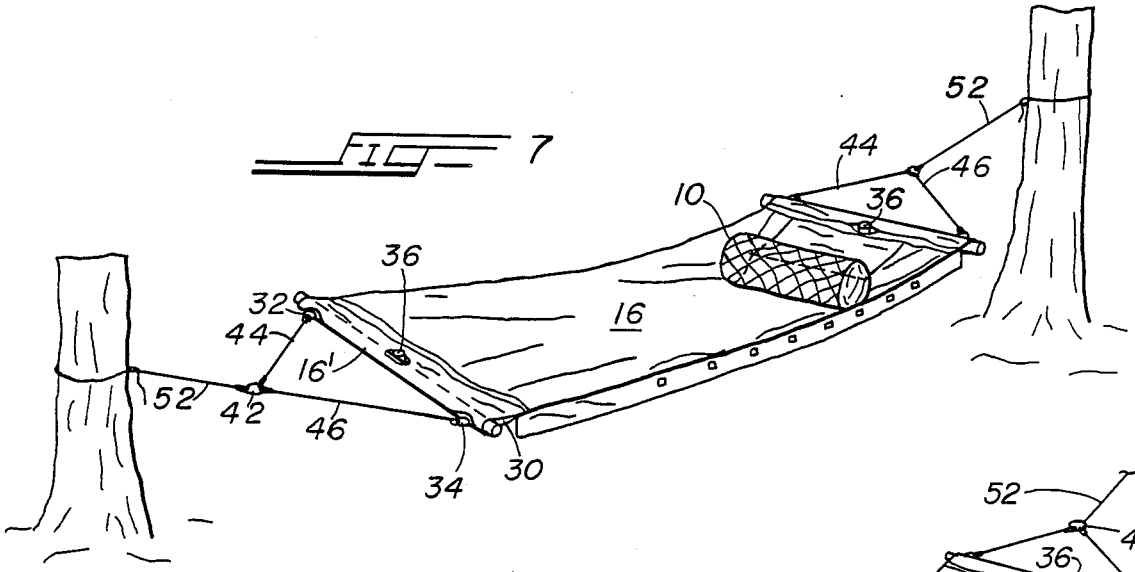
FIG. 7
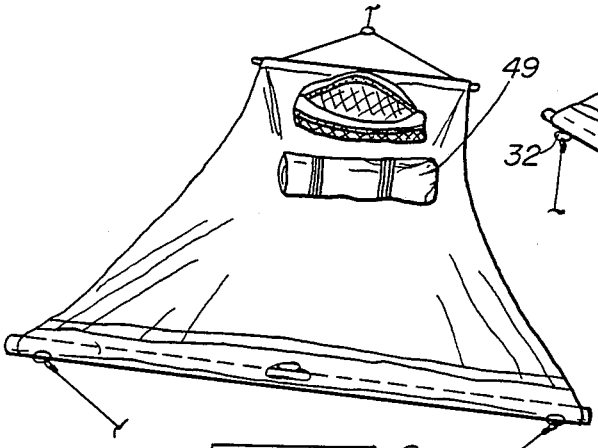
FIG. 8
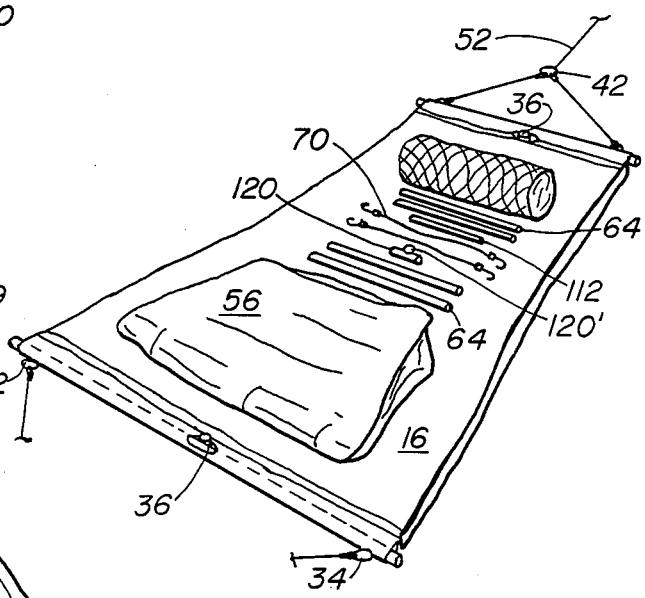
FIG. 9

68
66

68
66
80
80
58
77
78
64
70'
76
82
82
62
70
64
65
70"
16
63

42
70'
58
73
73
78
70
76
74
62
74'
74"
70"
72
72'
72"
42

80'
60
88
90
81
72
83
18
74
64
62
85
42
83
85
90

MULTIFORM CONVERTIBLE TENT AND HAMMOCK

The present invention is directed to a tent and hammock structure made up of a plurality of parts and elements which are capable of being distinctly and uniquely combined to form various types of tents and a hammock, each form or structure being easily assembled and easily transformed into another of the multifarious designs or structures. There exist prior art recombinative structures that are capable of being formed into a hammock or tent, such as those disclosed in the following U.S. Pat. Nos.: 4,526,307-Parker-, and 4,471,794-Kirkham.

None of the prior art recombinative, multiform structures offer a wide range of structures that may be formed that are suitable for different types of persons and environments. Though there are prior art structures that convert from a hammock to a tent, and vice versa, the tent or hammock formed is of limited capabilities, and function, and do not offer flexible or facile use. Furthermore, such prior art structures are not capable of expansion to allow for greater interior space to be provided.

SUMMARY OF THE INVENTION

It is the primary objective of the present invention to provide a recombinative, collapsible structure that may be formed into one of five different structures: a hammock, a hanging pup tent, a lean-to structure, a conventional ground pup tent, and an enlarged family tent made by combining two ground pup tents together.

It is another objective of the invention to allow to facile and easy erection of each of the five structures, as well as the transition from one to another.

It is yet another objective of the invention to contain all of the necessary component parts and materials in a easy-to-carry duffle-type bag, with the total weight thereof being approximately eight pounds.

Toward these and other ends, according to the invention there is provided a carrying bag storing therein a piece of flexible, rollable material that is used to form the first structure, a hammock. When the hammock is removed and unrolled from the carrying bag, it is still connected to the interior of the carrying bag so that the carrying bag may be used as a pillow for the hammock, the other material contents in the carrying bag serving as cushioning therefor. The hammock material is reinforced by a plurality of hollow interconnectable tubes at each end of the hammock material, which tubes are received in channels formed in the ends of the hammock material. The hammock ends are secured to a pair of trees via cords or ropes tied to loops formed in the end of each end tube at each end of the hammock proper.

The second structure, the hanging pup tent, is formd by firstly removing the remainder of the contents of the bag, which includes the tent proper and supporting hardware therefor. The tent proper is then secured to the edges of the hammock by conventional zippers, with the tent being erected by the insertion of two poles made of two interconnectable tubular elements at each end thereof, with the lower end of each pole being inserted into a central sleeve formed in the middle tube at each end of the hammock. The upper end of the pole is then inserted into an integrally formed receiving sleeve provided on the outer edge surface of each end of the tent proper, at the upper portion thereof. The resulting structure forms a hanging pup tent, hung between the same two, or two different, trees by which the hammock is hung.

The third structure is a land structure, a lean-to, which is formed from the same structure as that of the hanging pup tent, with the addition of another pair of elongated sticks or poles. The lean-to is formed by unzipping the back or rear side of the tent proper, and pivotting it upwardly about the pivot line defined by its connection with the top, vertex portion of the tent proper, to thereby expose the interior of the tent proper, as well as to provide a substantially horizontal overhang extending from the upper vertex area of the tent proper. The pivoted rear or back side or wall is retained in its pivoted, horizontal state by the additional pair of elongated sticks or poles, one pole at each corner edge of the overhung portion. One end of each pole is stuck into the ground, while the other, upper end is inserted into an integrally formed retaining sleeve provided at each corner edge of the overhung rear wall.

The fourth structure, the ground pup tent, is the same as the second structure, with the exception that the tent is on the ground and staked thereto.

The fifth structure is an enlarged tent made to hold up to six people, and is formed by joining two grounded pup tents formed in the fourth structure. The rear or back side or wall of each grounded pup tent is unzipped, as in the lean-to version, and pivoted a greater degree than in the lean-to version, such that the rear or back side of the tent proper of each grounded pup tent extends at the same angle with respect to the horizontal as the angle of slope of the front side of the tent proper, to thereby form one continuous sloping surface. The two half tents, or two transformed pup tents, are then attached to together by zipping the two pivoted rear sides together, which is achieved by the provision of supplemental material for each rear wall or side in the shape of a triangle, to fill in the open space formed by upwardly pivoted rear wall. Supplemental hardware is also provided for interconnecting the two half-tent or grounded pup tent portions together at the bases thereof formed by the plurality of interconnectable tubes.

BRIEF DESCRIPTION OF THE DRAWING

The invention will be more readily understood with reference to the accompanying drawings, wherein:

FIG. 5 is an assembly view, in perspective, showing the three interconnectable tubes for each end of the hammock material;

FIG. 6 is a detail view showing the manner of interconnection of each tube shown in FIG. 5 to each other;

FIG. 7 is an isometric view showing the first structure according to the invention, a hammock suspended between two trees;

FIG. 8 is a front view of the suspended hammock of FIG. 7, showing the tent material and hardware removed from the carrying bag;

FIG. 9 is an isometric view of the hammock of FIG. 7, with the hardware components for the tent proper laid out for subsequent use in forming the second structure according to the invention, a hanging pup tent;

DETAILED DESCRIPTION OF THE INVENTION

Figure 2:
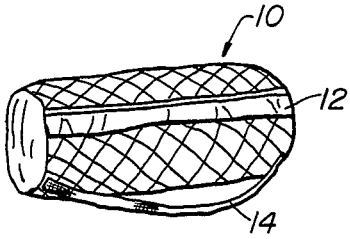
FIG. 2 is an isometric view of the carrying bag for storing and transporting all of the materials and component parts of the invention by which all of the five structures may formed.
Figure 3:
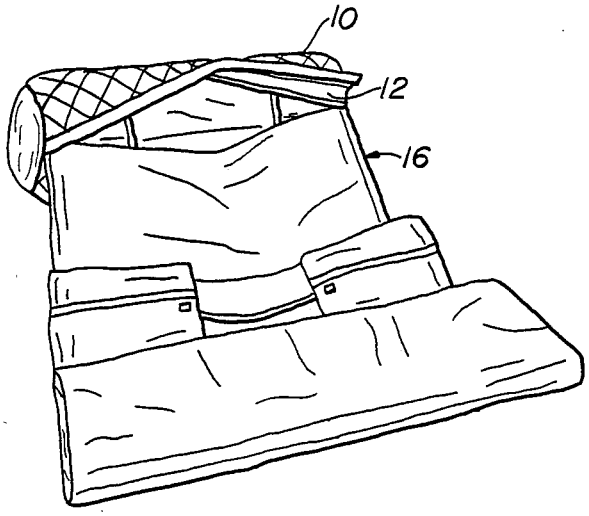
FIG. 3 is an isometric view showing the carrying bag opened and the hammock-material pulled out and still attached to the bag.
Figure 4:
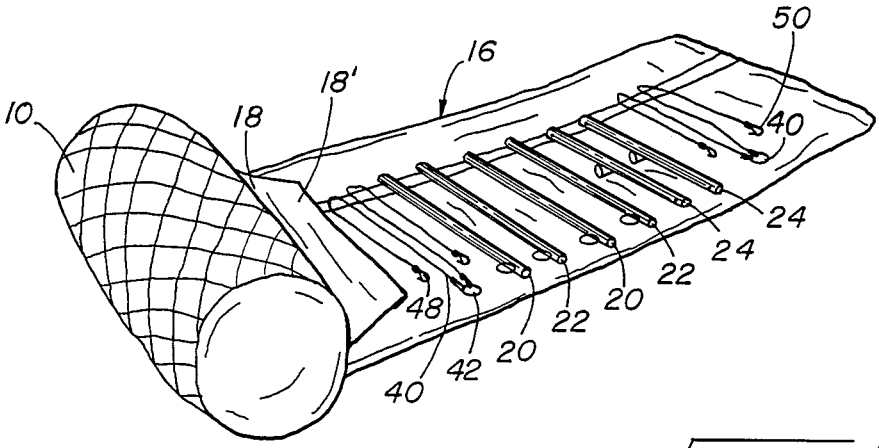
FIG. 4 is an isometric view showing the component parts for erecting the hammock.

Referring now to the drawings in greater detail, there is shown in FIG. 2, the duffle-bag type carrying bag 10 for storing and transporting the material and hardware components of the present invention for forming up to five different structures. The bag 10 has a reclosable slit-opening 12 through which the component parts of the invention may be removed. A strap 14 is also provided for shoulder-carrying of the bag. Upon opening the bag 10, the first component parts that are visible are those for forming the first structure of the invention, a hammock, as shown in FIGS. 3 and 4. The hammock is formed from a material component 16 that is preferable made of waterproof, water-repellant, rip-stop nylon, such as that used in parachutes, which component 16 is foldable and rollable. The carrying bag 10, after the material component 16 has been removed therefrom, still remains attached thereto via a flap 18, as shown in FIG. 4, so that the bag 10 may serve as a pillow for the hammock, especially since the tent material proper still remains in the interior of the bag to provide a cushion. The flap 18 is secured, as by stitching, to an end portion of the hammock component 16 via the edge 18′ thereof, so that the bag 10 may be oriented in the manner shown in FIG. 7, with the opening 12 face down, or alternatively in the manner shown in FIG. 9, with the opening 12 face up to allow for removal of the tent components.

The hardware components for the hammock structure are shown in FIGS. 4–6, and include a total of six hollow tubes, three for each end of the hammock component 16. As shown in FIG. 5, each set of three components has a pair of end tubes 20, 22, and a central tube 24. The three tubes are connectable via mating male and female couplers, such as projecting pin 26 at the inner end of each tube 20, 22 received in an L-shaped cutout 28 formed in each end of the tube 24, the pin 26 being locked in place by simple rotation of the respective tube to orient the pin within the right-angle portion of the cutout 28, in the manner shown in FIG. 6, it being understood that each tube 20, 22 has a smaller outer diameter than the inner diameter of the tube 24, to allow for the telescoping thereof. Each set of three tubes, when assembled, is positioned within an end channel 30 formed at each end of the hammock component 16, which channel is formed by a doubled-over portion 16′ as clearly shown in FIG. 7. The length of the set of three tubes, when assembled, is longer than the width of the hammock component 16, and, therefore, longer than the channel 30, so that the ends 20′ and 22′ protrude outwardly. The doubled-over portion or end edge projection 16′ has formed therein three openings, as shown in FIGS. 7–9, through which openings project hooks or loops 32, 34 formed in the tubes 20, 22, which loops 32, 34 lie substantially horizontally when projecting through the openings therefor in the portion 16′, which openings are positioned adjacent the ends of the channel 30, so that the loops may be used to attach the hammock to a tree trunk, as shown in FIG. 7. The third opening formed in the portion 16′ allows for the projection therethrough of a pole-receiving sleeve 36 of the central tube 24, so that the sleeve 36 projects substantially vertically when placed in the channel 30, for the reception therein of an end of a pole used in erecting a pup tent according to the second, third, and fourth structures formed by the present invention.

The hardware components for use in all of the five structures of the present invention, in order to attach the structure to a tree or the ground, are a pair of rope or cord components 40, each of which has a central loop 42 from which extends a pair of rope portions 44, 46 having at respective ends thereof hooks 48, 50 which tie the end of the respective rope portions to the loops 32, 34, as shown in FIGS. 7–9. Another rope portion 52 has one end affixed to the loop 42, while the other end thereof is used for securement to a tree trunk. The rope portions 52 are used to provide the proper tensioning to the hammock, so that it is held securely and taut, in the conventional manner.

Figure 1:
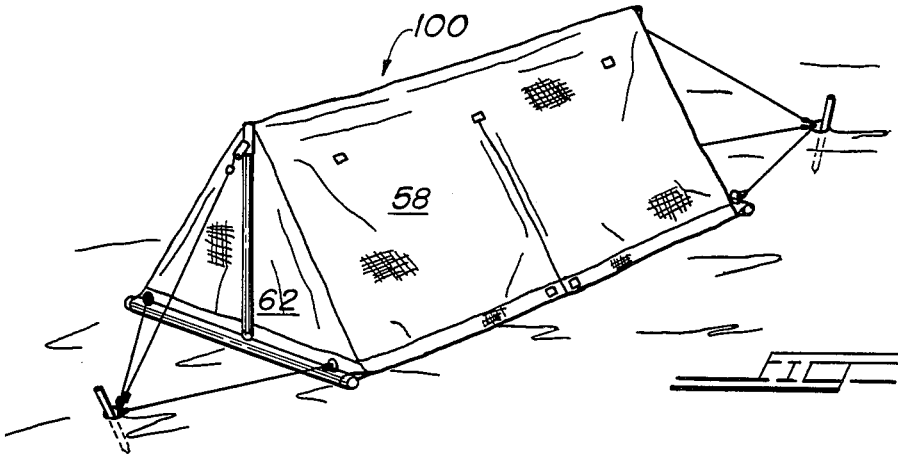
FIG. 1 is an isometric view showing one structure that may be formed according to the present invention, a grounded pup tent, which constitutes the fourth structure formed by the present invention.
Figures 10, 10A, 11, 12:
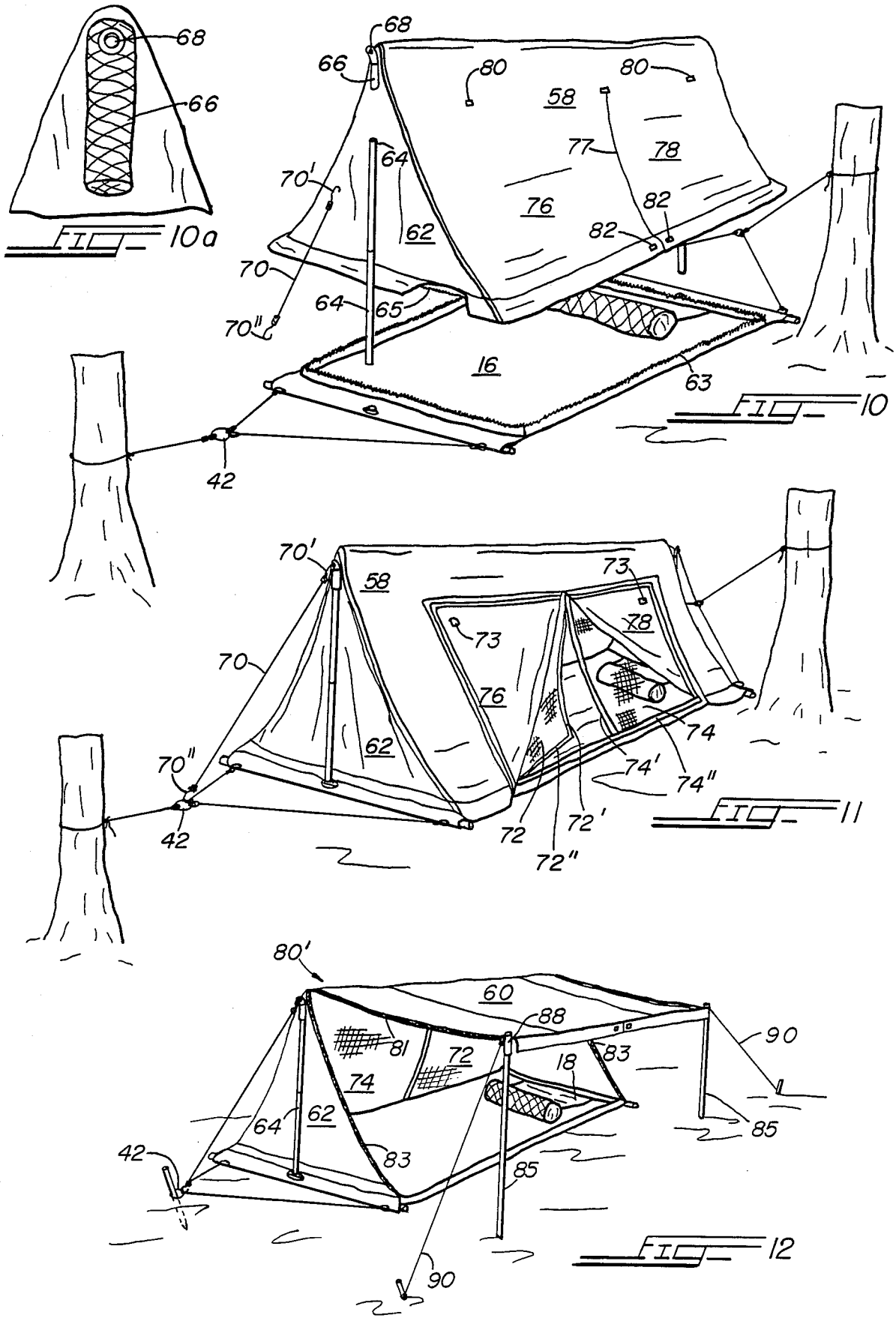
FIG. 10 is an isometric view showing the assembly, by zipping, of the tent proper to the suspended hammock in order to form the hanging pup tent.
FIG. 10*a* is a detail view showing the upper, vertex-located receiving sleeve of the tent proper for receiving and holding therein the erecting pole of the tent.
FIG. 11 is an isometric view showing an assembled hanging pup tent according to the second structure of the invention.
FIG. 12 is an isometric view showing the third structure according to the invention, a grounded lean-to, formed by pivoting upwardly the rear wall or side of the tent proper about its joinder with the vertex of the tent proper.

The second structure that may be formed by the present invention is that shown in FIG. 11, which is a hanging pup tent. This hanging pup tent is built by material component parts left in the bag 10, which component parts are shown in FIG. 9, laid out on the hammock 16. These parts include the tent material proper 56, which when erected forms a front wall 58, back wall 60, and side walls or surfaces 62 as seen in FIGS. 1 and 11. When the parts and tent material proper are removed from the bag 10, they are wrapped together into a bundle 49, a shown in FIG. 8. The hardware components include four erecting poles 64, two for each side 62 of the tent, as seen in FIG. 10. Each set of two erecting poles are assembled, with the lower end of the assembled pair being insertable into a respective sleeve 36 on the central pole 24, while the upper end thereof is insertable into a hollow, integrally-connected holding member or sleeve 66 positioned at the apex of the respective triangular-shaped side wall 62, as shown clearly in FIGS. 10. and 10A. Thus, with each set of pole-pairs inserted between respective sleeves 36, 66, each side wall 62 is thus erected. The tent proper has a rectilinear-shaped base of the same size as the hammock 16, so that cooperating zipper parts 63, 65 on the respective periphery of the bases of the tent proper and hammock proper allow for the securement of the base of the tent to the hammock, to thus form the hanging pup tent shown in FIG. 11. Each wall of the tent is also provided with overhanging flaps or skirts in order to aesthetically hide the zipper from view. The sleeve 66 is also formed with an upper eyelet or loop 68 so that a tensioning member 70 may be connected thereto. There are two such tensioning members 70, one for each side wall of the tent, which typically are bungi cords. Each member 70 has a first, upper hook-end 70' for insertion into one of the eyelets 68, and a second, lower hook-end 70'' for attachment to the ring 42. The two tensioning members or cords 70 provide the necessary tensioning along the length of the tent in order to stretch out the tent material to form a suitable tent.

The front wall 58 of the tent proper is provided with an access opening defined by a double layer: A first layer of netting and a second layer corresponding to the tent material itself, as seen in FIG. 11. The layer of netting actually consists of two side-by-side net-panels 72, 74, each having a substantially square-shape, and reclosably connectable together via hook-and-pile strips along adjoining edges 72', 74'. The edges 72', 72'', 74', 74'' are disconnected from the tent proper, in order to allow for the folding of each net panel over itself to allow entry and exit, while the remaining two edges of each panel are sewed or otherwise attached to the tent material. The overlying layer of tent material is also formed into a pair of panels 76, 78. Each panel 76, 78 has cooperating hook-and-pile fasteners 80, 82, as shown in FIG. 10, that allow for the retention of each tent panel in a doubled-over triangle, as shown in FIG. 11, so as to expose the inner net panels, the edges of the tent panels corresponding to the edges 72, 74', 72', 74'' also being free from connection with the tent proper to allow for the doubling-over thereof. The underside of each tent panel 76, 78, on the corner edges of the skirt of each, is provided with another half 73 of a hook-and-pile fastener, which cooperate with mating halves formed on the outer corner surface of each net panel 72, 74, so that each net panel, when doubled over upon itself, may be retained in its open position. The two tent panels are also held in their closed state by additional strips of hook-and-pile fasteners, as shown by line 77 in FIG. 10.

The third structure that may be formed by the present invention is a lean-to, shown in FIG. 12. The lean-to 80' is formed by disconnecting the rear wall or surface 60 of the tent from the two side walls 62, by zipper portions 81, 83 on the edges of the rear wall and side walls, respectively. The rear wall is then rotated upwardly about a pivot line defined by its joinder with the apex of the tent, so as to expose the interior of the tent, and to form an overhang, as clearly shown in FIG. 12. The overhang, or rear wall, 60 is retained in such state by sticks or poles 85, with one end of each stick resting on the ground, and the other end received in sleeves 88 integrally connected to each corner edge of the rear wall. Ropes 80 secure the overhang, one end of each rope being fastened to a loop formed with the respective sleeve 88. The lean-to is also secured to the ground via the ring 42 by stakes.

The fourth structure that may be formed according to the invention is a ground pup tent 100, shown in FIG. 1. This structure is the same as the lean-to 80' with the only difference being that the rear wall 60 is in its normal, closed state with the edge surfaces thereof connected to the side walls of the tent via the cooperating zipper portions 81, 83. Of course, in this structure, the ropes 90 and sticks 85 are not used.

Figure 13:
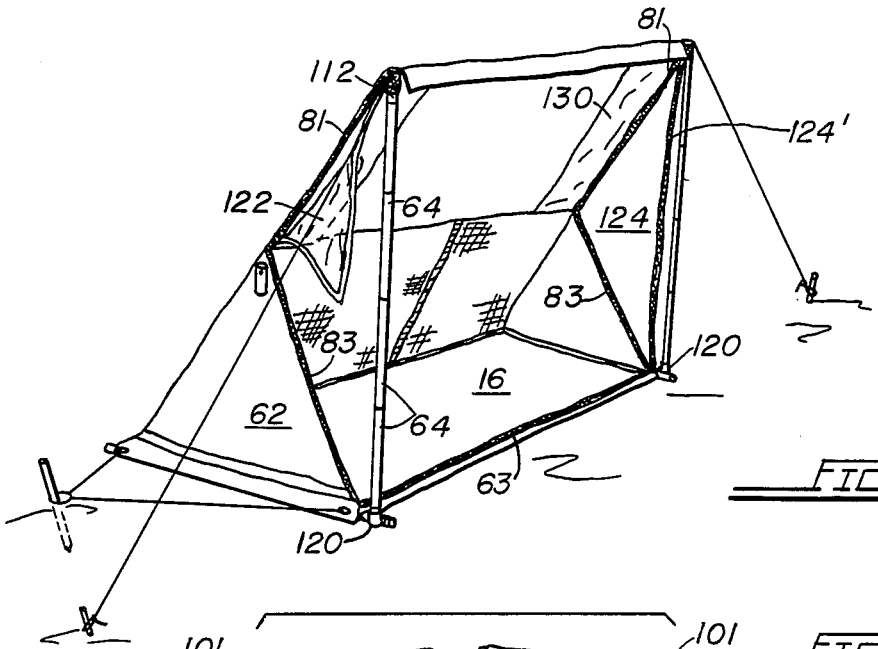
FIG. 13 is an isometric view showing the transformation of the tent proper or lean-to into half a full tent, which full tent constitutes the fifth structure according to the invention, and being made from two transformed pup tents, each transformed tent being formed by firstly pivoting the rear wall or side in the same manner of forming the lean-to but to a height where the rear wall forms a surface extension of the front wall or side.
Figure 14:
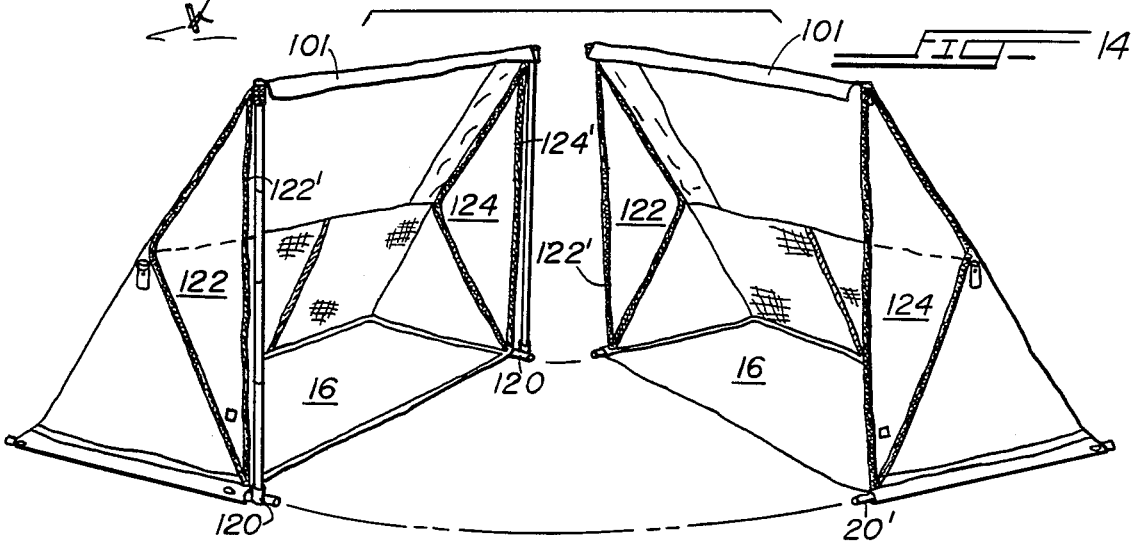
FIG. 14 is an assembly view, in perspective, showing the formation of one full tent according to the fifth structure of the invention, by zipping together two transformed tents shown in FIG. 13.
Figure 15:
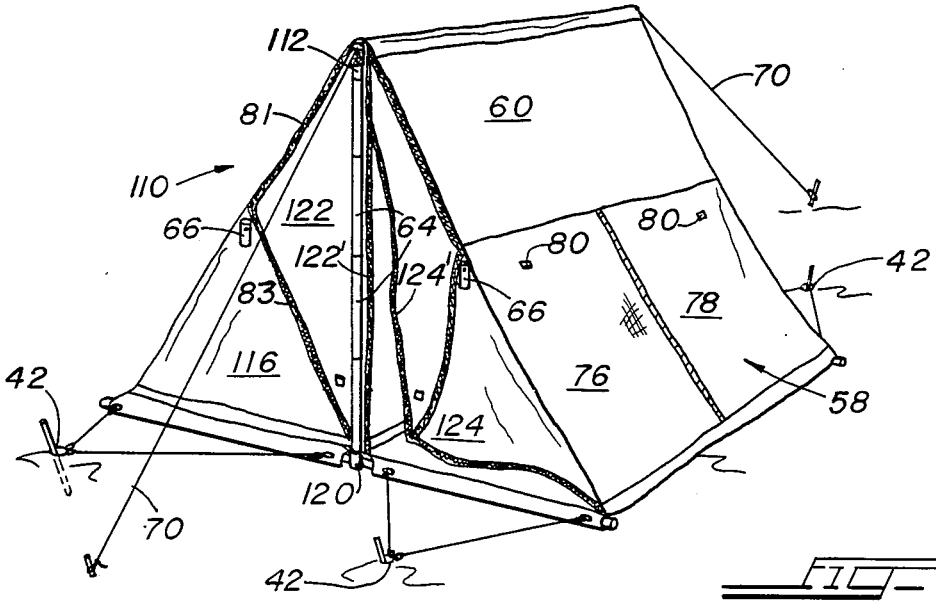
FIG. 15 is an isometric view showing an erected full-sized family tent made from two transformed pup tents of FIG. 13.

The fifth structure that may be formed according to the invention is shown in FIG. 15, which is a full, family-sized tent 110. The tent 110 is made up of two half-tents or pup tents 100 of FIG. 1. To erect the full tent 110, two such pup tents 100 are needed. Each pup tent 100 is transformed in the manner that the lean-to m80' is formed. That is, the rear wall 60 is disconnected at its edge surfaces via the zipper parts 81, 83 from the sides 62, and pivoted upwardly. However, when forming the full tent, the rear wall 60 is pivoted upwardly to a greater degree, such that the rear wall 60 lies coplanar, and forms one continuous surface, with the front wall 58, as shown in FIG. 13. To retain the rear wall in this upwardly pivoted state, the four poles or tubes 64 are used for one side, while the four tubes 64 from the other or second pup tent are used for the other side 62, each set of four poles or tubes 64 being supplemented with an extension pole or tube 112, one such extension pole or tube 112 being provided with each pup tent. Each set of tubes 64 and extension tube 112 is used to shore up or erect one of the sides 116 of the full tent in the manner to be described. Each pup tent is also provided with one T-bar accessory tube 120 for connecting one side of one pup tent with the corresponding side of the other pup tent, as shown in FIG. 15. Each T-bar accessory unites the base of the two pup tents via facing or adjoining ends 20', 22' of the tubes 20, 22 of the two pup tents. These ends 20', 22' project outwardly beyond the respective channel so as to facilitate insertion of the respective end into the juxtapositioned T-bar, to thereby unite the two pup tents at their bases. The T-bar accessory also has an upwardly projecting, hollow sleeve 120' (see FIG. 9) into which is telescoped the end of the lowermost pole or tube 64, to thereby vertically orient these poles. The upper end of the topmost extension pole or tube 112 is received in the receiving sleeve 88, as described above in reference to the erection of the lean-to. With the rear wall 60 in the position shown in FIG. 13, a supplemental material 122, 124 is removed from pockets 130 provided on the undersurface of the rear wall, at each end thereof. Each pocket 130 opens outwardly, in the direction facing away from the interior of the tent, so that each supplemental piece of material 122, 124 may be pulled out therethrough. Each piece of material 122, 124, when unfolded, is in the shape of a triangle, having a surface area substantially the same as the area defined between the respective tubes 64, 112 and the exposed edge surfaces 81, 83 of the rear wall and side wall 62. Two edges surfaces of each piece of material are provided with a zipper strip or portion, the vertical edge surface 122', 124' and the lower sloped edge surface adjacent the edge surface 83 of the side wall, by which each piece of material may be secured to a respective side wall. The upper sloped edge surface adjacent the edge surface 81 of the rear wall is preferably sewn to the tent material proper itself, to the undersurface of the rear wall, so that each piece of material is neatly and securely contained in its pocket and easily removed and positioned readily into its use-position. One piece 122 has the slide of the zipper, while the other 124 does not. The two half tents are united along the four juxtapositioned opposed edge surfaces of each, each of the four edge surfaces having a zipper strip or portion. To accomplish this unification, each of the edge surfaces 63 and lower edge surface of the rear wall, hidden from view by the skirt 101, is provided with two zipper portions or half strips, with one having a slide, so that type may be joined to other in the same tent for the second, third and fourth structures, and so that each may be joined to its like counterpart on the other half tent to form the full family-size tent. When erected, the complete, full, family-size tent has two entrances, constituted by the fronts of the two pup tents from which it is made. The poles 64 are interconnected in any conventional manner, such as that disclosed for the tubes 20, 22, 24. The full tent 110 is staked to the ground via the rings 42, there now being four in all.

While a specific embodiment of the invention has been shown and described, it is to be understood that numerous changes and modifications may be made without departing from the scope and spirit of the invention as set forth in the appended claims.

What is claimed is:

1. A tent, comprising:

a front wall having an entrance opening;

a rear wall;

a pair of side walls interconnecting said front and rear walls;

said rear wall having a first and a second side edge surface, and each said side wall having one edge surface for joining with a respective one of said first and second side edge surfaces of said rear wall; each said one edge surface having first reclosable means, and each said first and second edge surfaces having mating second reclosable means for mating engagement with said first reclosable means, so that said rear wall may be alternatively attached to said side walls or detached therefrom;

said tent further comprising a pair of shaped material inserts, one said insert for each side of said tent, each said insert comprising attaching means for each of the three edge surfaces thereof for attaching said insert to a respective said side wall, to said rear wall, and to the like-insert of another like-tent juxtapositioned thereto, whereby the two tents may be coupled to each other to form a full-sized tent.

2. The tent according to claim 1, wherein said attaching means of said second edge surface of each said insert comprises means for permanently uniting the respective said second edge surface to a respective one of said first and second side edge surfaces of said rear wall.

3. The tent according to claim 1, further comprising a first and a second erecting means associated with a respective one of said pair of side walls for keeping said walls in their erect states, each said side wall comprising cooperating means for receiving one of said first and second erecting means, each said erecting means having a height dependent upon the height of said walls as defined by said apex; said cooperating means of each said side wall being located generally centrally thereof in a vertical plane containing therein said apex; each said erecting means comprising a plurality of tubes detachably securable together; said rear wall comprising a pair of lower corner edges, and a pair of receptacle means mounted to said pair of corner edges, one said receptacle means for one said corner edge; and a first and a second supplemental erecting tube operatively associated with said first and second erecting means, respectively, each of said first and second supplemental erecting tubes being attachable to the upper end of the topmost one of said tubes of said first and second erecting means, respectively, to form a higher erecting means, whereby each said higher erecting means comprises an upper end insertable into one of said receptacle means for elevating said rear wall in its upwardly-pivoted state.

4. A hammock comprising:

a bag storage means having a hollow interior and an access opening to said hollow interior;

a flexible, foldable material for storage in said hollow interior, said material, when unfolded and stretched out, forming a hammock proper upon which one may lie when suspended between two fixed objects, such as trees;

said material having a first end portion and a second end portion;

connecting means firmly connecting an intermediate portion of said material to said bag storage means at an interior surface portion of said bag storage means defining part of the boundary of said hollow interior, so that, when said material is removed from said hollow interior via said access opening, said material is connected to said interior surface portion of said bag storage means in order to form a pillow for said hammock proper; said intermediate portion of said material lying closer to one said end portion of said material then the other said end portion thereof when said material is unfolded and stretched out to form said hammock proper;

means for suspending said material at said first and second end portions between two fixed objects to form said hammock proper; and said one end having an end-edge projecting laterally beyond said bag storage means in a direction away from the other said end portion so that said one end portion may be connected to a fixed object with said bag storage means spaced from the fixed object.

* * * * *